US009969076B2

(12) United States Patent
Tsai

(10) Patent No.: US 9,969,076 B2
(45) Date of Patent: May 15, 2018

(54) CONNECTION DEVICE FOR HEXAGONAL WRENCH

(71) Applicant: Chung-Yu Tsai, Taichung (TW)

(72) Inventor: Chung-Yu Tsai, Taichung (TW)

( * ) Notice: Subject to any disclaimer, the term of this patent is extended or adjusted under 35 U.S.C. 154(b) by 413 days.

(21) Appl. No.: 14/729,083

(22) Filed: Jun. 3, 2015

(65) Prior Publication Data

US 2016/0354916 A1 Dec. 8, 2016

(51) Int. Cl.
*B25G 1/08* (2006.01)
*B25B 15/00* (2006.01)

(52) U.S. Cl.
CPC ..... *B25G 1/085* (2013.01); *B25B 15/008* (2013.01)

(58) Field of Classification Search
CPC ..... B25G 1/085; B25B 15/008
USPC ..... 81/177.4
See application file for complete search history.

(56) References Cited

U.S. PATENT DOCUMENTS 6,209,425 B1 * 4/2001 Hu ..... B25B 15/008 81/177.1
6,332,381 B1 * 12/2001 Vasudeva ..... B25B 15/008 81/177.1
6,971,291 B2 * 12/2005 An ..... B25B 15/008 81/177.2
7,717,016 B2 * 5/2010 Lai ..... B25B 23/0042 81/177.1
7,788,996 B2 * 9/2010 Johnson ..... B25B 13/56 81/177.1
9,463,568 B2 * 10/2016 Chen ..... B25G 1/063

* cited by examiner

*Primary Examiner* — Hadi Shakeri

(57) ABSTRACT

A connection device for a hexagonal wrench and includes a first part and a second part. The first part has an insertion section through which multiple hexagonal first recesses are defined, and an operation portion formed on one end thereof. The operation portion has multiple second hexagonal second recesses. The second part has a reception hole in which the insertion section is inserted and is positioned relative to the second part. The second part has an opening and the first recesses are exposed. The second part has another operation portion on one end thereof. The operation portion has multiple third hexagonal recesses. The first, second and third hexagonal recesses have different sizes and are Metric system and English system.

14 Claims, 11 Drawing Sheets

C-C

B-B

CONNECTION DEVICE FOR HEXAGONAL WRENCH

BACKGROUND OF THE INVENTION

1. Fields of the invention

The present invention relates to a hexagonal wrench, and more particularly, to a connection device for being cooperated with a hexagonal wrench.

2. Descriptions of Related Art

The conventional connection compensating device of multi-angular wrench socket is disclosed in U.S. Pat. No. 6,971,291, and comprises a main body which is a cylindrical body, outer circumference of the main body between two ends thereof is formed with several radially arranged flutes which extend along a circular axis of the main body by a certain length. The flutes have different cross-sectional areas. A connecting section includes a first tubular body fitted around the main body, the first tubular body being rotatable about the circular axis of the main body. The first tubular body is partially overlaid on the flutes. A geometric central axis of the profile of inner circumference of the first tubular body is not coincided with the circular axis of the main body.

However, when in use, as shown in FIG. 3 of the U.S. Pat. No. 6,971,291, when the wrench is engaged with the flutes of the main body and the inner circumference of the first tubular body, the wrench can easily slip away from the flute. Besides, when the main body is connected to the connecting section, the wrench can only be engaged with one of the flutes so that the function is not expandable.

The present invention intends to provide a connection device for a hexagonal wrench to eliminate the shortcomings mentioned above.

SUMMARY OF THE INVENTION

The present invention relates to a connection device for a hexagonal wrench and comprises a first part and a second part. The first part has an insertion section through which multiple hexagonal first recesses are defined, and an operation portion formed on one end thereof. The operation portion has multiple second hexagonal second recesses. The second part has a reception hole in which the insertion section is inserted and is positioned relative to the second part. The second part has an opening and the first recesses are exposed. The second part has another operation portion on one end thereof. The operation portion has multiple third hexagonal recesses. The first, second and third hexagonal recesses have different sizes and are Metric system and English system.

The primary object of the present invention is to provide a connection device which provides multiple hexagonal recesses of Metric and English systems, and the hexagonal recesses have different sizes for being cooperated with different sizes of hexagonal wrenches.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 2:
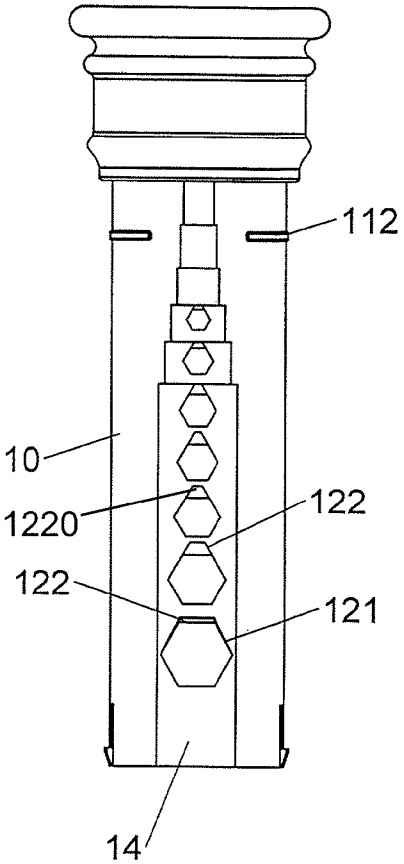
FIG. 2 shows a bottom view of the first part of the connection device of the present invention.
Figure 5:
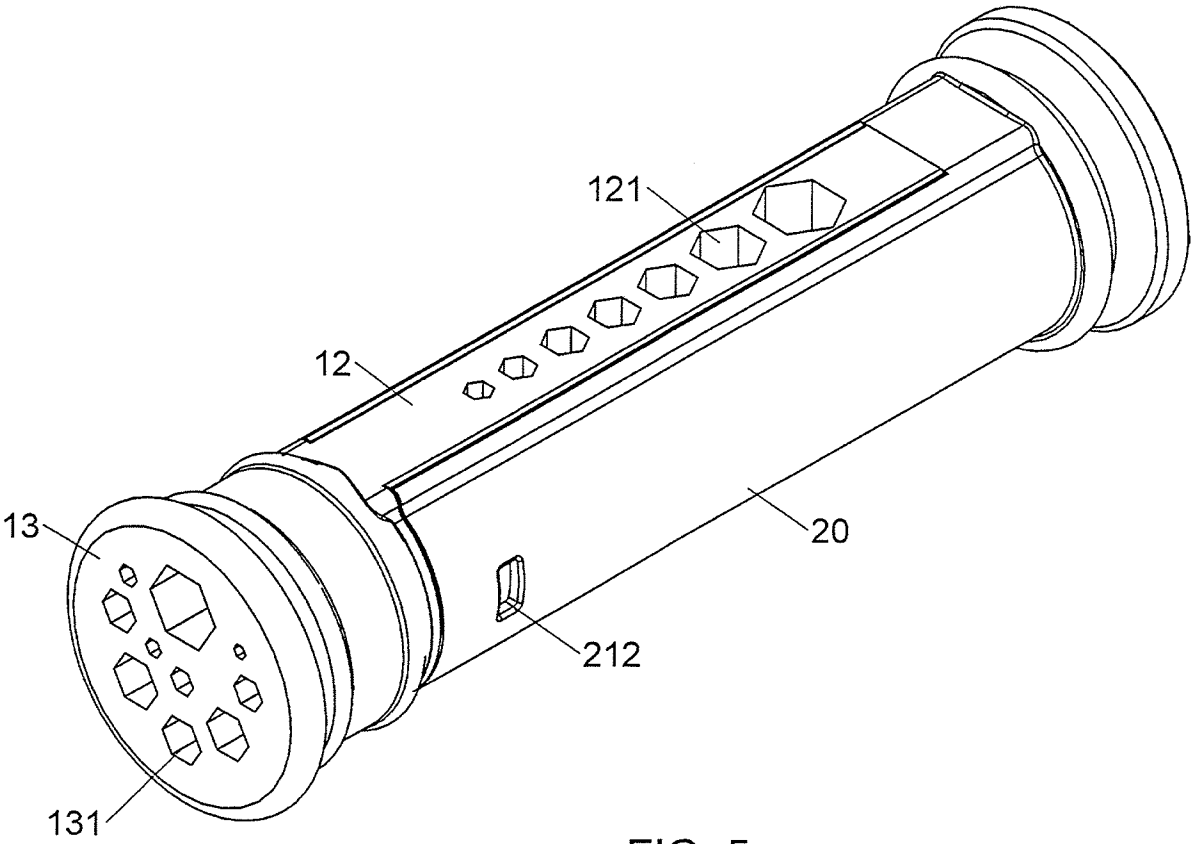
FIG. 5 is a perspective view to show the connection device of the present invention.

Referring to FIGS. 1 to 5, the connection device of the present invention comprises a first part 10 and a second part 20. The first part 10 has an insertion section 11 which is a cylindrical section. Two first engaging portions 111 are formed on the first end of the insertion section 11, and two second engaging portions 112 are formed on the second end of the insertion section 11. The two first engaging portions 111 each have a hook 1110 formed on the outside at its distal end thereof. The second engaging portions 112 each are a ridge protruding from the outer surface of the insertion section 11. The second engaging portions 112 longitudinally extending with respect to the central axis of the insertion section 11 about 30 to 80 degrees (preferably 60 to 80 degrees), i.e. the second engaging portions 112 longitudinally extending with respect to the central axis of the insertion section 11 with the angle at the circumference about 30 to 80 degrees (preferably 60 to 80 degrees). The top of the second engaging portion 112 viewed from the cross section of the second engaging portion 112 extends along an arc. The insertion section 11 has a first operation portion 12 formed on the outer surface thereof, the first operation portion 11 is a flat surface 120. Multiple first recesses 121 defined in the first operation portion 12 and each having a hexagonal shape. The first recesses 121 are defined through the insertion section 11 and arranged in sequence by sizes. As shown in FIG. 2, one of the six sides of each of the first recesses 121 has an inclined angle 122 extending from middle portion of the first recess 121 to one end of the first recess 121 to form an expanded opening 1220, and the expanded opening 1220 of the first recess 121 allows a tool such as a hexagonal wrench to be easily inserted into the first recess 121. A second operation portion 13 protrudes from the second end of the first part 10 and is a flat surface. The second operation portion 13 has multiple second recesses 131 which have a hexagonal shape and different sizes. The first recesses 121 and the second recesses 131 are Matric system and English system. The insertion section 11 has a stepped recess 14 defined axially in the first end thereof and extends toward the second end of the insertion section 11. The size of the stepped recess 14 becomes smaller from the first end toward the second end of the insertion section 11. The first recesses 121 communicating with the stepped recess 14. The outer periphery of the insertion section 11 has at least two first limit faces 110, the inner periphery of the reception hole 21 has at least two second limit faces 210, and the at least two first limit faces 110 contact the at least two second limit faces 210 so as to restrict the first part 10 rotating with respect to the second part 20. In a preferable embodiment, there are at least five first limit faces 110 continuously roundly distributing with respect to the central axis of the first part 10, there are at least five first second faces 210 continuously roundly distributing with respect to the central axis of the second part 20, and each first limit face 110 and each second limit face 210 are a flat plane respectively.

The second part 20 is a hollow cylindrical member and has a reception hole 21 defined in the first end thereof. The insertion section 11 is inserted into the reception hole 21. The reception hole 21 has two third engaging portions 211 formed in the first end of the reception hole 21 of the second part 20, and two fourth engaging portions 212 are formed in the second end of the reception hole 21 of the second part 20. The third engaging portions 211 are defined in the inner surface of the reception hole 21 and each third engaging portion 211 is recess. The fourth engaging portions 212 are two rectangular holes defined through the wall of the reception hole 21 of the second part 20. The third and fourth engaging portions 211, 212 are sized to be engaged with the first engaging portions 111 when the insertion section 11 is moved along the reception hole 21 in two different positions. Two fifth engaging portions 213 formed in the inner surface of the second end of the reception hole 21 and each of the fifth engaging portion 213 is a groove so as to receive the second engaging portion 112 therein. A protrusion 214 extends from the inner surface of the reception hole 21 and is accommodated in the stepped recess 14 so as to define a gap between the top of the protrusion 214 and the inner surface of the stepped recess 14. The second part 20 has an opening 22 which is a rectangle-shaped opening and communicates with the reception hole 21. The first operation portion 12 and the first recesses 121 are exposed from the opening 22. A third operation portion 23 is a flat surface and extends from the second end of the second part 20. The third operation portion 23 has multiple third recesses 231 which have different sizes. The third recesses 231 are hexagonal recesses which are Matric system recesses and English recesses. Referring to FIGS. 1 to 5, when in use, the insertion section 11 is inserted into the reception hole 21 of the second part 20, and the first engaging portions 111 are engaged with the third engaging portions 211, and the second engaging portions 112 are engaged with the fifth engaging portions 213 to position the first part 10 relative to the second part 20. The protrusion 214 received in the stepped recess 14. The first operation portion 12 and the first recesses 121 are exposed from the second part 20 via the opening 22. The second operation portion 13 and the third operation 23 have the same shape and size, which make the connection device have organized appearance.

Figure 6:
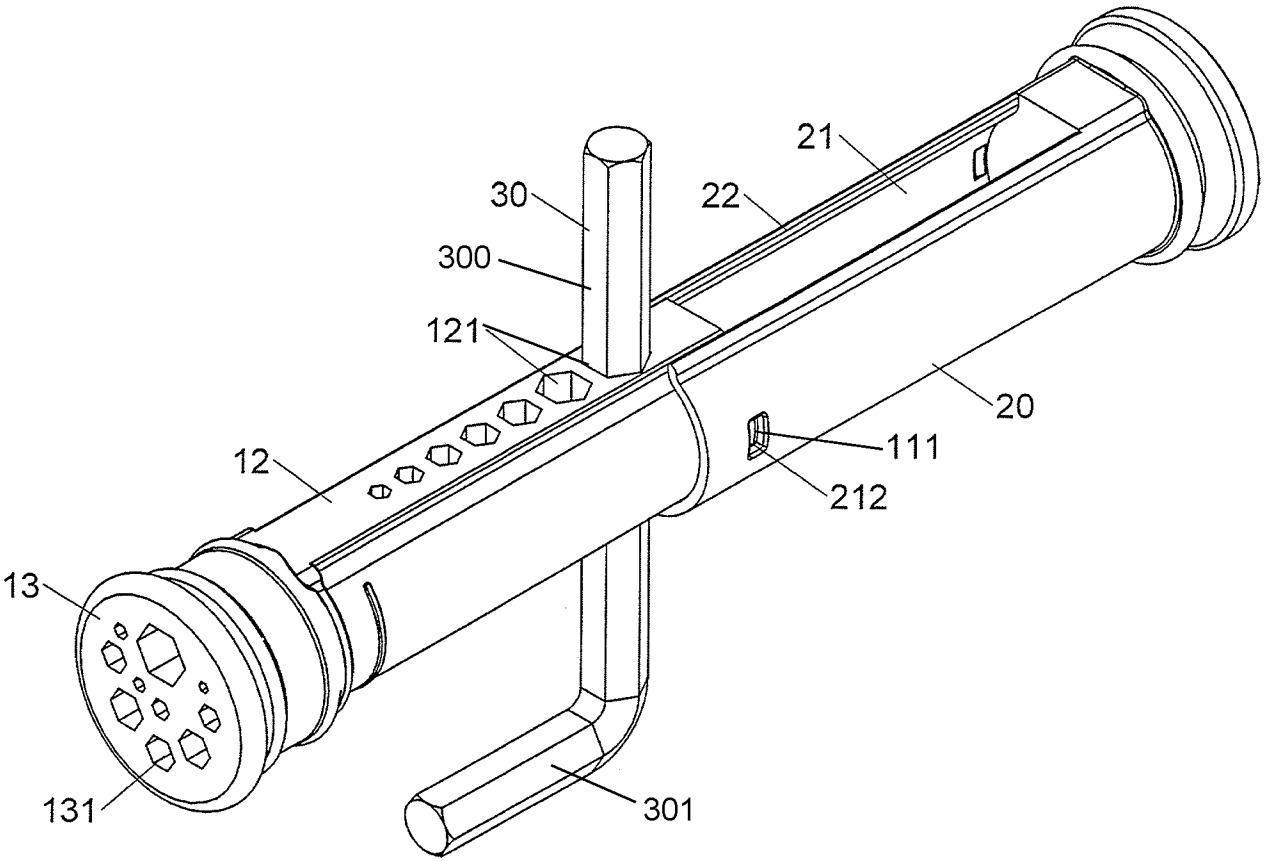
FIG. 6 shows a hexagonal wrench is connected to one of the first recesses of the connection device of the present invention, wherein the first part is positioned at one position relative to the second part.

As shown in FIG. 6, the user may pull the first part 10 away from the reception hole 21 to disengage the first engaging portions 111 from the third engaging portions 211, until the first engaging portions 111 are engaged with the fourth engaging portions 212 to position the first part 10 to the second part 20 again. The first part 10 is separated from the second part 20. The first recesses 121 are completely exposed from top to bottom, so that the long section 300 of the L-shaped hexagonal wrench 30 can be inserted into the first recess 121.

Figure 7:
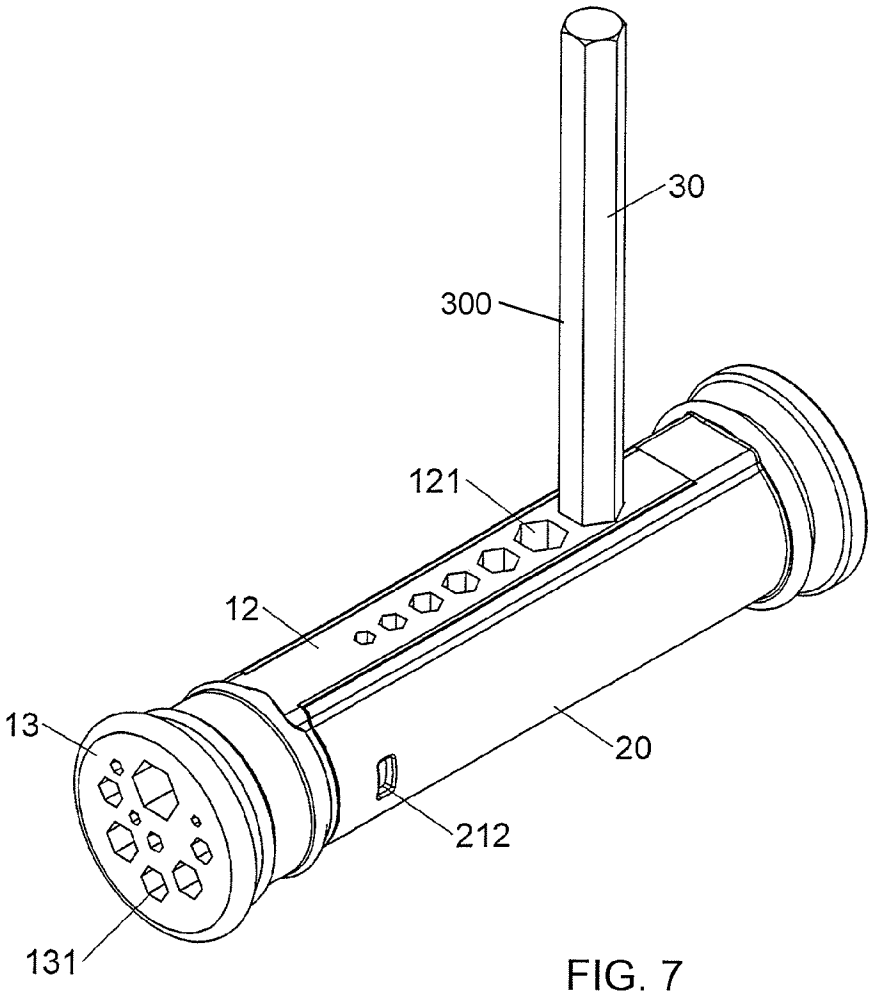
FIG. 7 shows another hexagonal wrench is connected to one of the first recesses of the connection device of the present invention, wherein the first part is positioned at another position relative to the second part.

As shown in FIG. 7, the user pushes the insertion section 11 into the reception hole 21 to disengage the first engaging portions 111 from the fourth engaging portions 212, and the first engaging portions 111 are then engaged with the third engaging portions 211 and the second engaging portions 112 are engaged with the fifth engaging portions 213. The short section 301 of the L-shaped hexagonal wrench 30 is received in the stepped recess 14.

Figure 9:
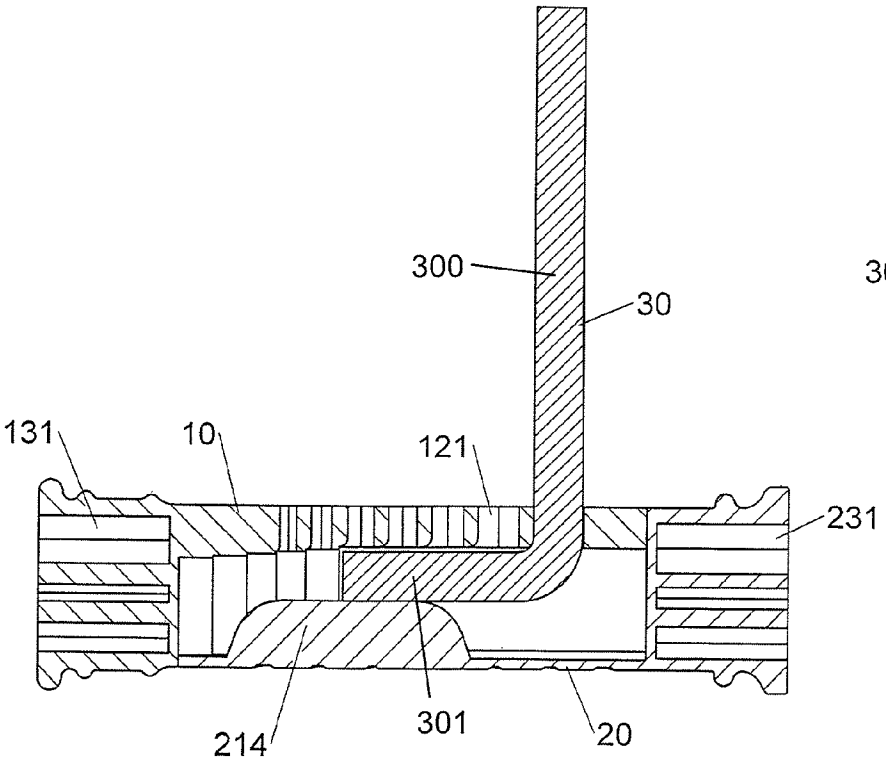
FIG. 9 is a cross sectional view, taken along line B-B in FIG. 8.
Figure 8:
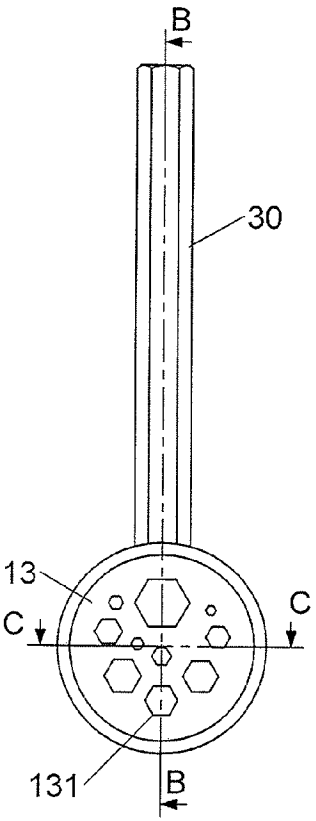
FIG. 8 is an end view to show the hexagonal wrench in FIG. 6 connected to one of the first recesses of the connection device of the present invention.

As shown In FIGS. 8 and 9, the short section 301 contacts the top of the protrusion 214 and the inner surface of the stepped recess 14, so that the hexagonal wrench 30 is securely position. When the user rotates the first and second parts 10, 20, the hexagonal wrench 30 is rotated to tighten or loosen an object (not shown).

Figure 10:
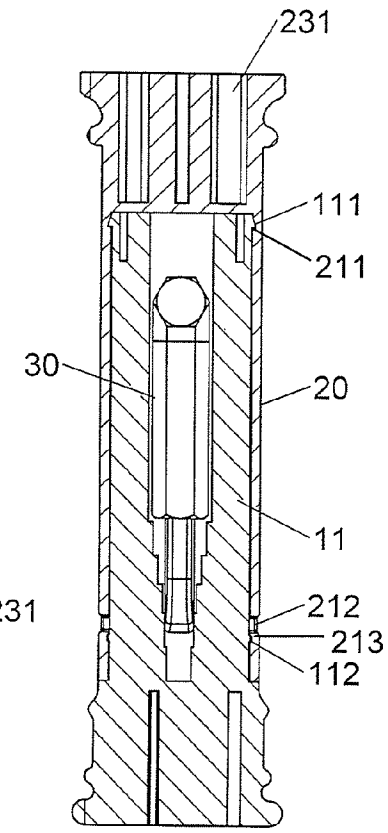
FIG. 10 is a cross sectional view, taken along line C-C in FIG. 8.

FIG. 10 shows that the insertion section 11 is inserted into the reception hole 21, the first engaging portions 111 are engaged with the third engaging portions 211, and the second engaging portions 112 are engaged with the fifth engaging portions 213. The first part 10 is securely connected to the second part 20 by the two positions of engagement.

Figure 1:
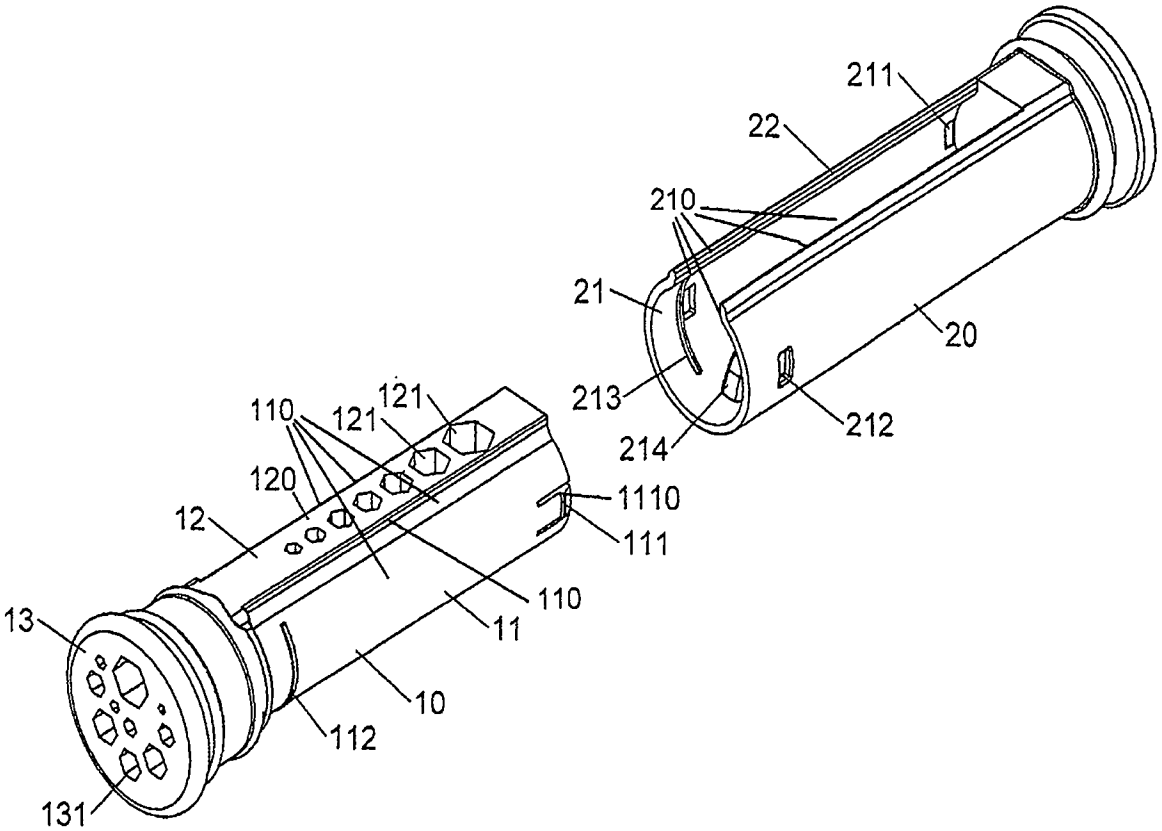
FIG. 1 is an exploded view of the connection device of the present invention.
Figure 3:
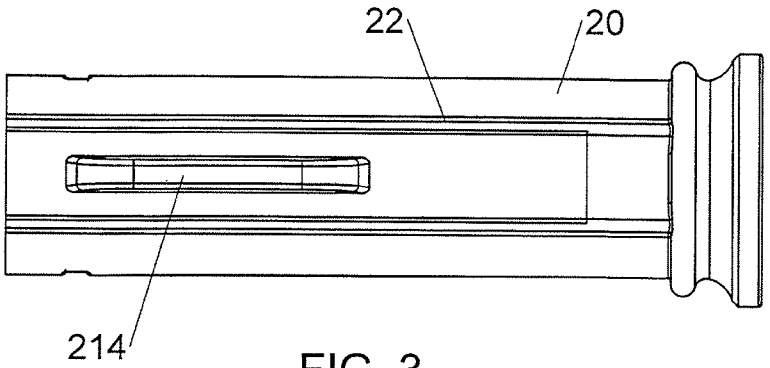
FIG. 3 shows a top view of the second part of the connection device of the present invention.
Figure 4:
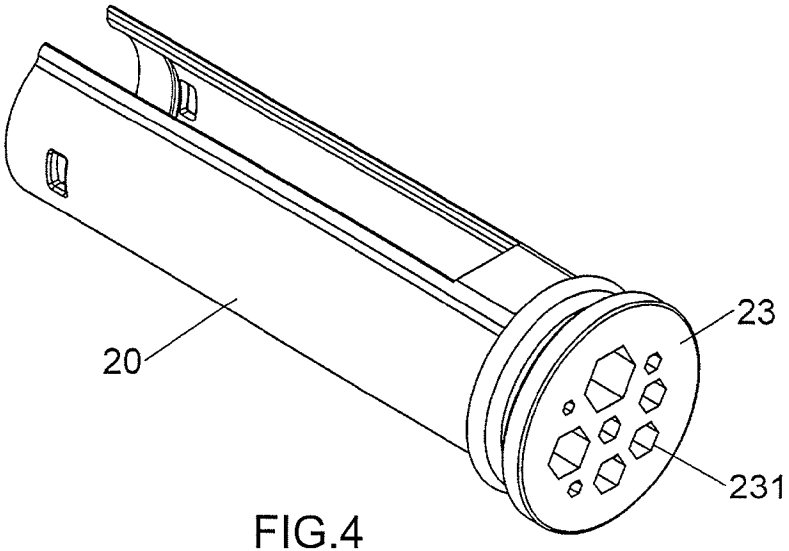
FIG. 4 is a perspective view to show the second part of the connection device of the present invention.
Figure 11:
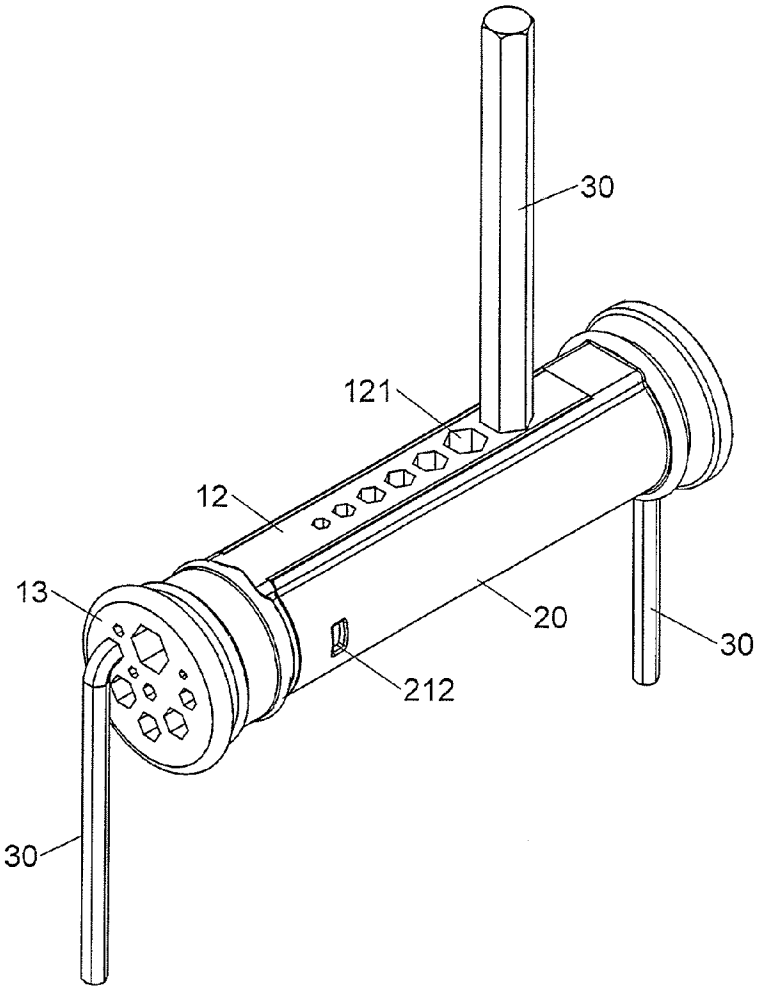
FIG. 11 shows three hexagonal wrenches are connected to the connection device of the present invention.

FIGS. 4 and 11 show that the first, second and third recesses 121, 131, 231 are sized for being connected with the hexagonal wrenches 30 of different specifications.

Figure 12:
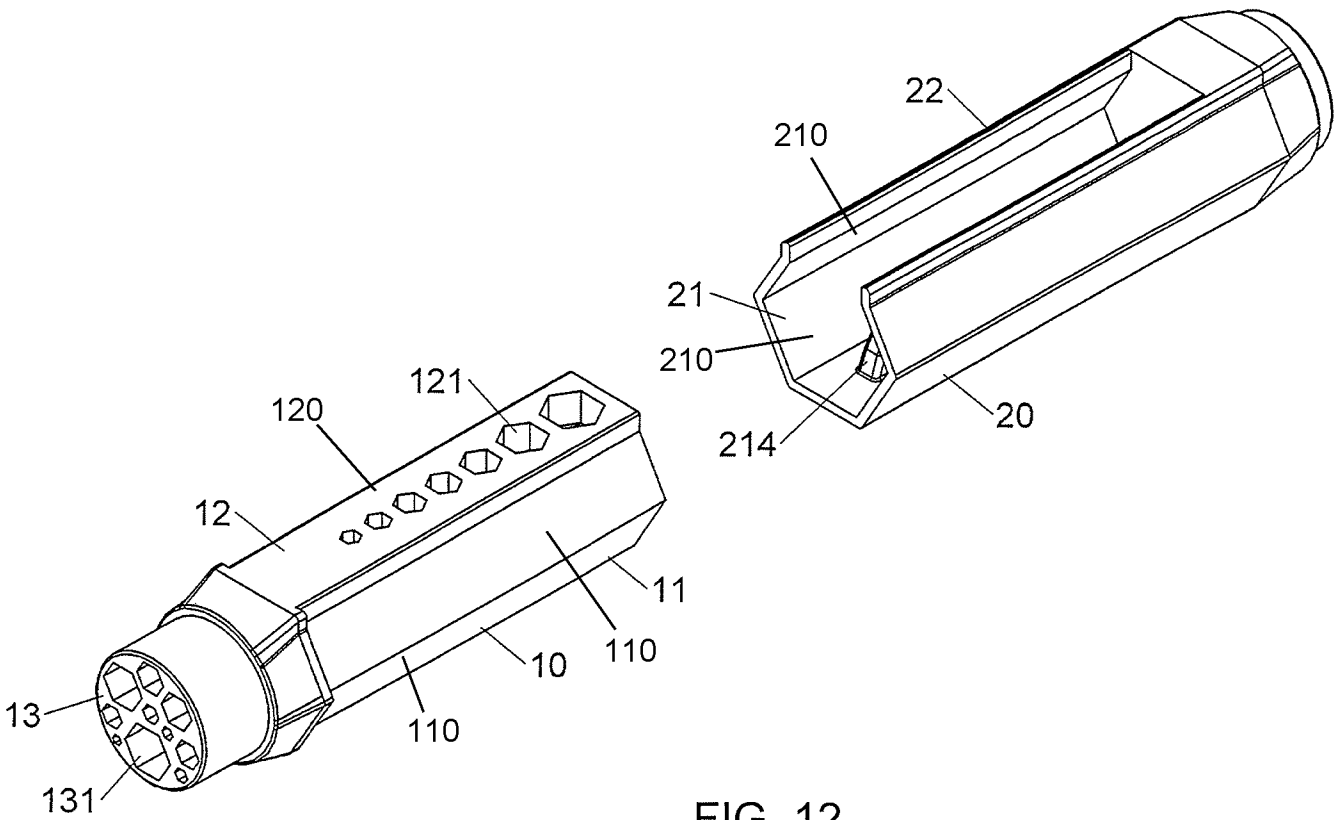
FIG. 12 is an exploded view of the second embodiment of the connection device of the present invention.

FIG. 12 show that each of the first and second parts 10, 20 has a polygonal cross section. The first part 10 does not have the first and second engaging portions 111, 112, and the second part 20 does not have the third, fourth and fifth engaging portion 211, 212, 213. The insertion section 11 can be moved and separated from the reception hole 21 along the axial direction.

Figure 13:
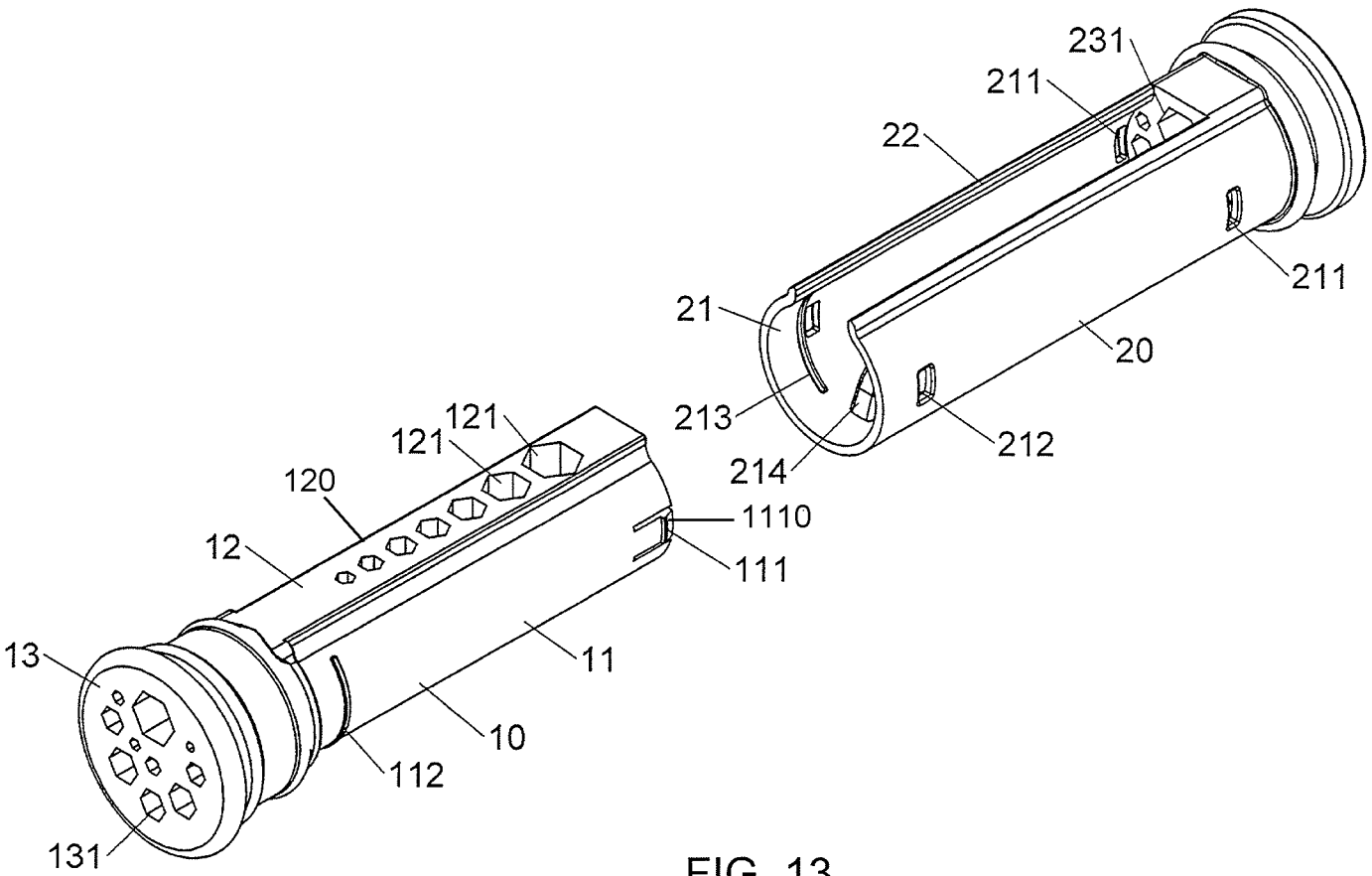
FIG. 13 is an exploded view of the third embodiment of the connection device of the present invention.

FIG. 13 shows that the third engaging portions 211 are defined through the wall of the third operation portion 23. The reception hole 21 communicates with the third recesses 231.

Figure 14:
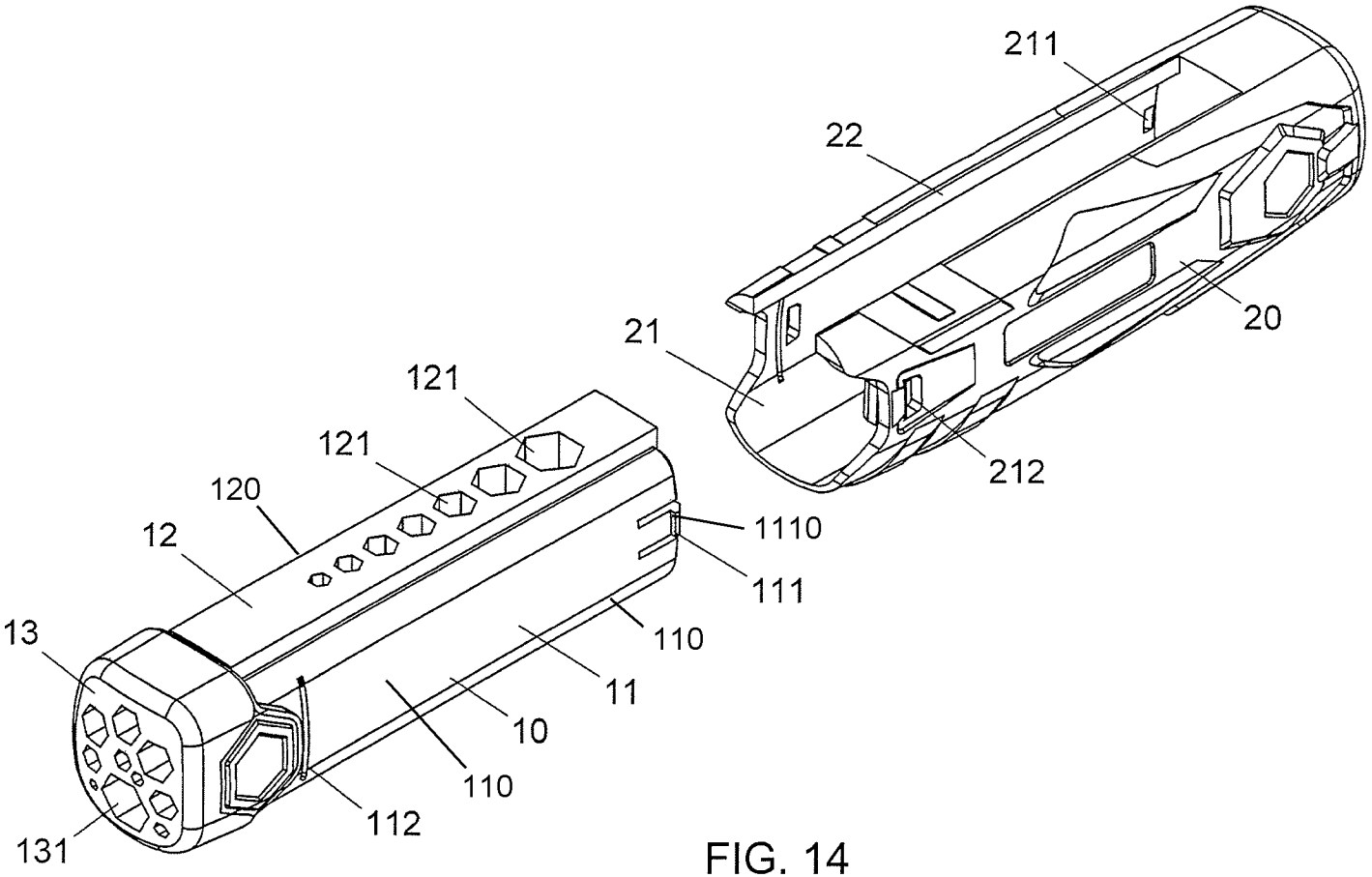
FIG. 14 is an exploded view of the fourth embodiment of the connection device of the present invention.
Figure 15:
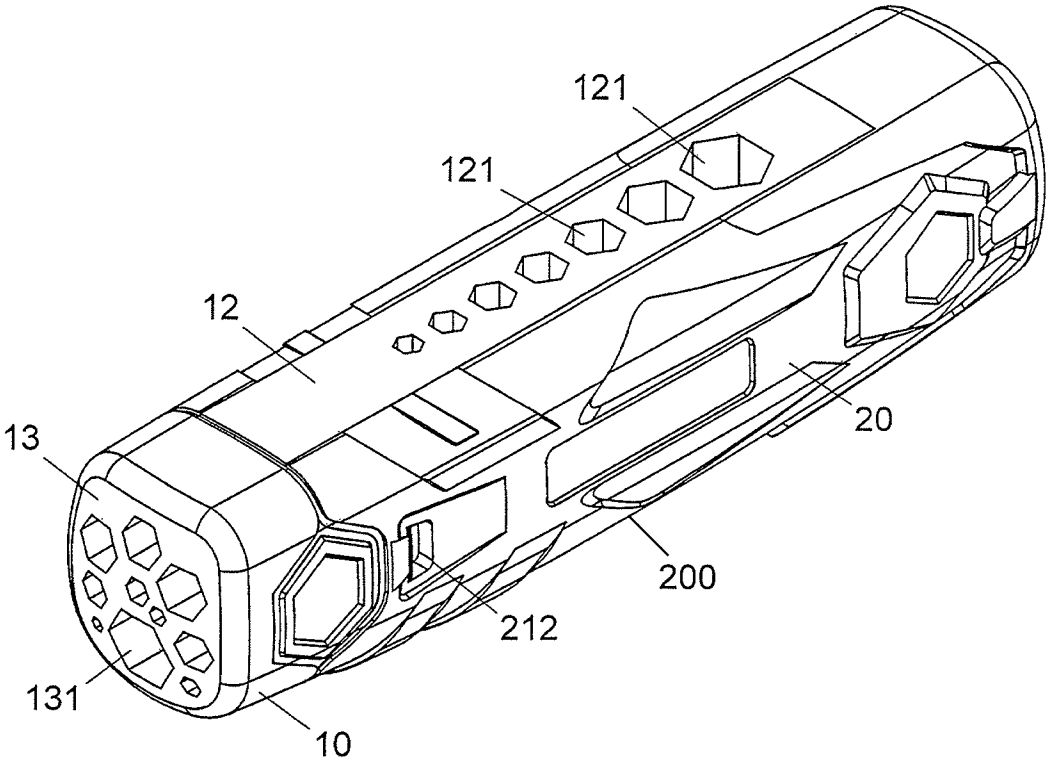
FIG. 15 is a perspective view to show the connection device in FIG. 14 of the present invention.

FIGS. 14 and 15 show that the cross section of the first and second parts 10, 20 is a rectangular cross section. The bottom 200 of the second part 20 extends along the axis direction and forms a curved path which is easily grasped by the users.

While we have shown and described the embodiment in accordance with the present invention, it should be clear to those skilled in the art that further embodiments may be made without departing from the scope of the present invention.

What is claimed is:

1. A connection device for a hexagonal wrench, comprising:

a first part having an insertion section, two first engaging portions formed on a first end of the insertion section, two second engaging portions formed on a second end of the insertion section, the two first engaging portions each being a hook, the second engaging portions each being a ridge protruding from an outer surface of the insertion section, the insertion section having a first operation portion formed on the outer surface thereof, multiple first recesses defined in the first operation portion and each having a hexagonal shape, the first recesses defined through the insertion section and being arranged in sequence by sizes, a second operation portion protruding from the second end of the first part and having multiple second recesses which have a hexagonal shape and different sizes, the first recesses and the second recesses being Matric system and English system, the insertion section having a stepped recess defined axially in the first end thereof, a size of the stepped recess becomes smaller from the first end toward the second end of the insertion section, the first recesses communicating with the stepped recess;

a second part having a reception hole defined in a first end thereof, the insertion section being inserted into the reception hole, the reception hole having two third engaging portions formed in a first end of the reception hole, two fourth engaging portions formed in a second end of the reception hole, the third engaging portions being defined in an inner surface of the reception hole and being two recesses, the fourth engaging portions being two rectangular holes defined through a wall of the reception hole, the third and fourth engaging portions being sized to be engaged with the first engaging portions when the insertion section is moved along the reception hole, two fifth engaging portions being formed in the inner surface of the second end of the reception hole and each of the fifth engaging portion being a groove so as to receive the second engaging portion therein, a protrusion extending from the inner surface of the reception hole and accommodated in the stepped recess so as to define a gap between a top of the protrusion and an inner surface of the stepped recess, the second part having an opening which communicates with the reception hole, the first operation portion and the first recesses being exposed from the opening, the opening being a rectangle-shaped opening, a third operation portion extending from the second end of the second part and having multiple third recesses which have different sizes, the third recesses being hexagonal recesses which are Matric system recesses and English recesses, and an outer periphery of the insertion section having at least two first limit faces, an inner periphery of the reception hole having at least two second limit faces, and the at least two first limit faces contacting the at least two second limit faces so as to restrict the first part rotating with respect to the second part; wherein the second engaging portions longitudinally extending with respect to a central axis of the insertion section with an angle at the circumference about 30 to 80 degrees.

2. The connection device as claimed in claim 1, wherein the insertion section is a cylindrical section and the second part is a hollow cylindrical member.

3. The connection device as claimed in claim 1, wherein the first operation portion is a flat surface.

4. The connection device as claimed in claim 1, wherein the second operation portion is a flat surface.

5. The connection device as claimed in claim 1, wherein one of the six sides of each of the hexagonally shaped first recesses has an inclined angle extending from middle portion of the first recess to one end of the first recess to form an expanded opening, and the expanded opening allows the hexagonal wrench to be easily inserted into the first recess.

6. The connection device as claimed in claim 1, wherein the angle at the circumference is 60 to 80 degrees.

7. The connection device as claimed in claim 1, wherein the top of the second engaging portion viewed from a cross section of the second engaging portion extends along an arc.

8. The connection device as claimed in claim 1, wherein the third operation portion is a flat surface.

9. The connection device as claimed in claim 1 further comprising a hexagonal wrench which has a short section and a long section, the short section is engaged between the top of the protrusion and the inner surface of the stepped recess.

10. The connection device as claimed in claim 1, wherein there are at least five first limit faces continuously roundly distributing with respect to the central axis of the first part, there are at least five first second faces continuously roundly distributing with respect to the central axis of the second part, and each first limit face and each second limit face are a flat plane respectively.

11. The connection device as claimed in claim 1, wherein each of the first and second parts has a polygonal cross section.

12. The connection device as claimed in claim 1, wherein the third engaging portions are defined through a wall of the second part, the third and fourth engaging portions have the same shape.

13. The connection device as claimed in claim 1, wherein the third recesses are defined through a wall of the third operation portion, the reception hole communicates with the third recesses.

14. The connection device as claimed in claim 1, wherein the two first engaging portions each have a hook formed on a distal end thereof.

* * * * *